US006988771B1

(12) United States Patent
Huang

(10) Patent No.: US 6,988,771 B1
(45) Date of Patent: Jan. 24, 2006

(54) HEALTHFUL CUSHION

(76) Inventor: Pu-Ching Huang, 9F, No. 195, Sec. 2, Huanher West Road, Yonher City, Taipei Hsien 23444 (TW)

( * ) Notice: Subject to any disclaimer, the term of this patent is extended or adjusted under 35 U.S.C. 154(b) by 0 days.

(21) Appl. No.: 11/028,194

(22) Filed: Jan. 4, 2005

(30) Foreign Application Priority Data

Oct. 22, 2004 (CN) ..... 93216878 U

(51) Int. Cl.
*A47C 31/00* (2006.01)

(52) U.S. Cl. ..... 297/219.1; 297/223; 297/283.1

(58) Field of Classification Search ..... 297/219.1, 297/223, 452.27, 452.17, 283.1; 5/655.4, 5/655.9, 953, 653, 906
See application file for complete search history.

(56) References Cited

U.S. PATENT DOCUMENTS 1,857,418 A * 5/1932 Wedler ..... 297/219.1
1,964,242 A * 6/1934 Behrle ..... 297/223
3,109,474 A * 11/1963 Levi ..... 150/158
5,557,815 A * 9/1996 Mintz et al. ..... 5/636
D380,921 S * 7/1997 Ruscitti ..... D6/596
5,778,470 A * 7/1998 Haider ..... 5/645
6,588,840 B1 * 7/2003 Lombardo ..... 297/228.12

* cited by examiner

*Primary Examiner*—Laurie K. Cranmer
(74) *Attorney, Agent, or Firm*—Charles E. Baxley

(57) ABSTRACT

A healthful cushion comprises an outer shield member, a plastic pad, a first cushion member and a second cushion member. The outer shield member provides six cloth strips, which is sewed to form a shape of cross with a central section and four outward extending sections. The central section has a plurality of openings and each of the cloth strips having a secure part at both ends thereof for being adhered to each other. The plastic pad is attached with a Velcro part and provides magnetic pieces on the Velcro part. The first cushion member is a quadrilateral bag corresponding to the central section of the outer shield member with crystals being stuffed inside. The second cushion member provides the same configuration as the first cushion member with soft stuff inside. The first cushion member, the second cushion member and the plastic pad are wrapped with the outward extending sections of the outer shield member. The cushion members can be exchanged positions thereof depending on different seasons and temperature change to enhance use with warmness in the winter and coolness in the summer.

3 Claims, 6 Drawing Sheets

HEALTHFUL CUSHION

BACKGROUND OF THE INVENTION

1. Field of the Invention:

The present invention is related to a healthful cushion and particularly to a healthful cushion with which the interior can be changed depending on different seasons and the user can adjust positions of the magnetic pieces to align with acupuncture points of his/her body.

2. Brief Description of Related Art:

The conventional cushion is mostly placed on seat part of a chair to offer the user a support with softness different from seat part. However, the traditional cushion generally is filled with a piece of sponge or granular cushion substances so that it is not possible to provide different effects in accordance with weather and seasonal changes. For instance, it is easy to sweat at the hip in the summer time in case of the sponge being used and a uncomfortable cold feeling is experienced at the hip in the winter time in case of the granular cushion substances being used.

SUMMARY OF THE INVENTION

A main object of the present invention is to provide a healthful cushion with which the interior can be changed depending on different seasons and the user can adjust positions of the magnetic pieces to align with acupuncture points of his/her body.

In order to achieve the preceding object, the healthful cushion according the present invention includes:

- an outer shield member, providing six cloth strips being sewed to form a shape of cross with a central section and four outward extending sections, the central section having a plurality of openings and each of the cloth strips having a secure part at both ends thereof for being adhered to each other;
- a plastic pad, being attached with a Velcro sheet, providing a plurality of magnetic pieces and each of the magnetic pieces being covered with a net cloth at the upper side thereof;
- a first cushion member, being a quadrilateral bag corresponding to the central section of the outer shield member with zippers being attached to the periphery thereof and crystals being stuffed inside thereof; and
- a second cushion member, providing the same configuration as the first cushion member with soft stuff inside.

Hence, the first cushion member and the second cushion member can be changed positions each other by the user depending on the weather to reach the purpose of warmness in the winter and coolness in the summer.

BRIEFE DESCRIPTION OF THE DRAWINGS

The detail structure, the applied principle, the function and the effectiveness of the present invention can be more fully understood with reference to the following description and accompanying drawings, in which.

DETAILED DESCRIPTION OF THE PREFERRED EMBODIMENT

Figure 1:
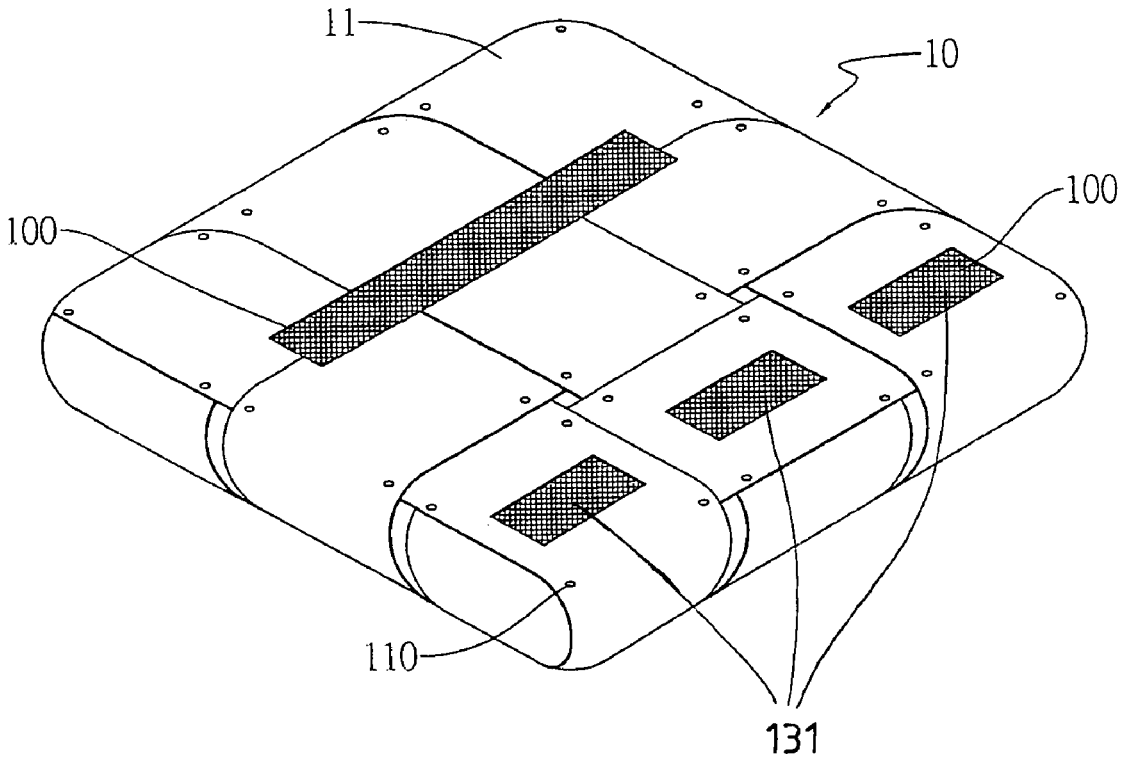
FIG. 1 is a perspective view of a healthful cushion of a first preferred embodiment according to the present invention.
Figure 2:
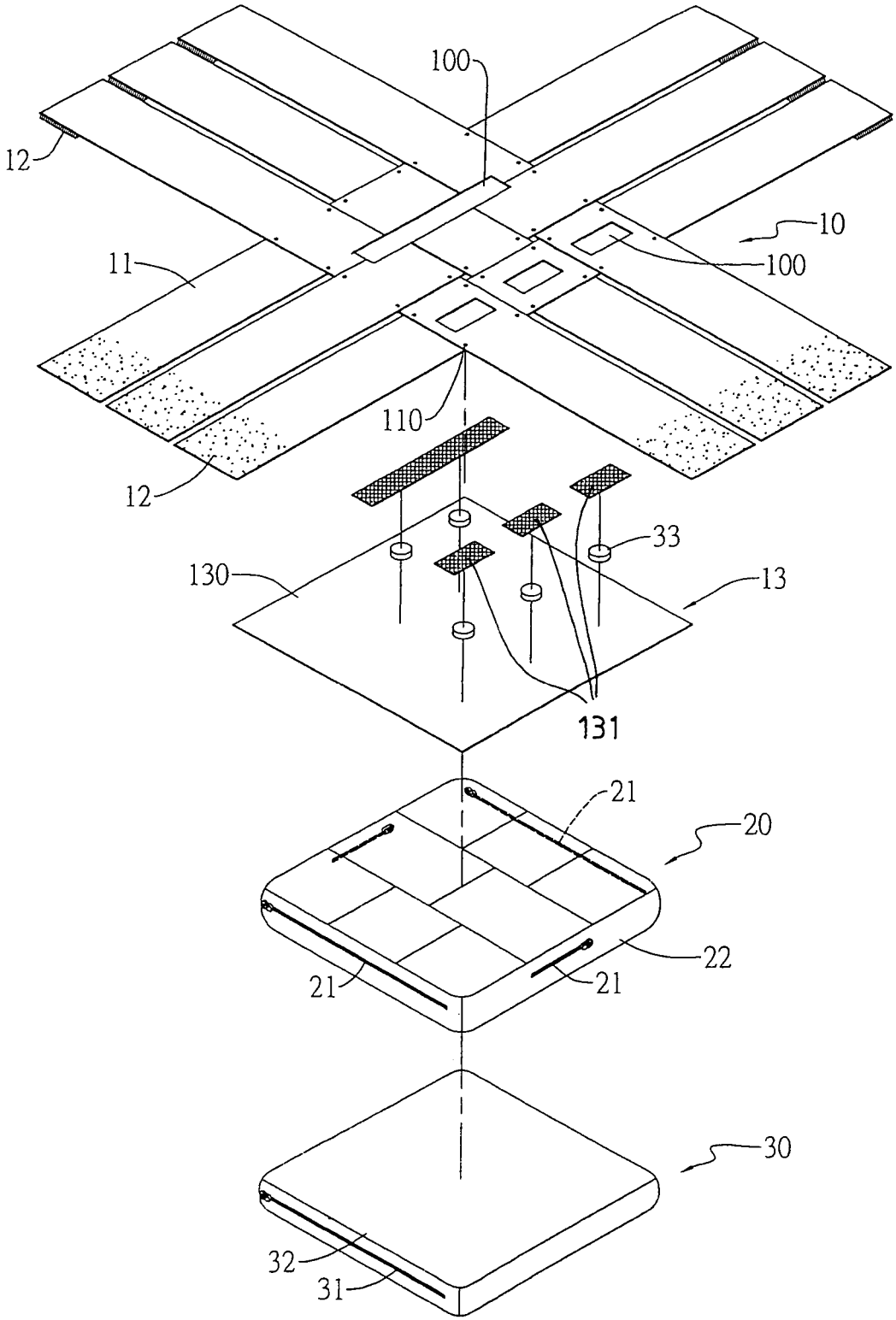
FIG. 2 is an exploded perspective view of FIG. 1.
Figure 3:
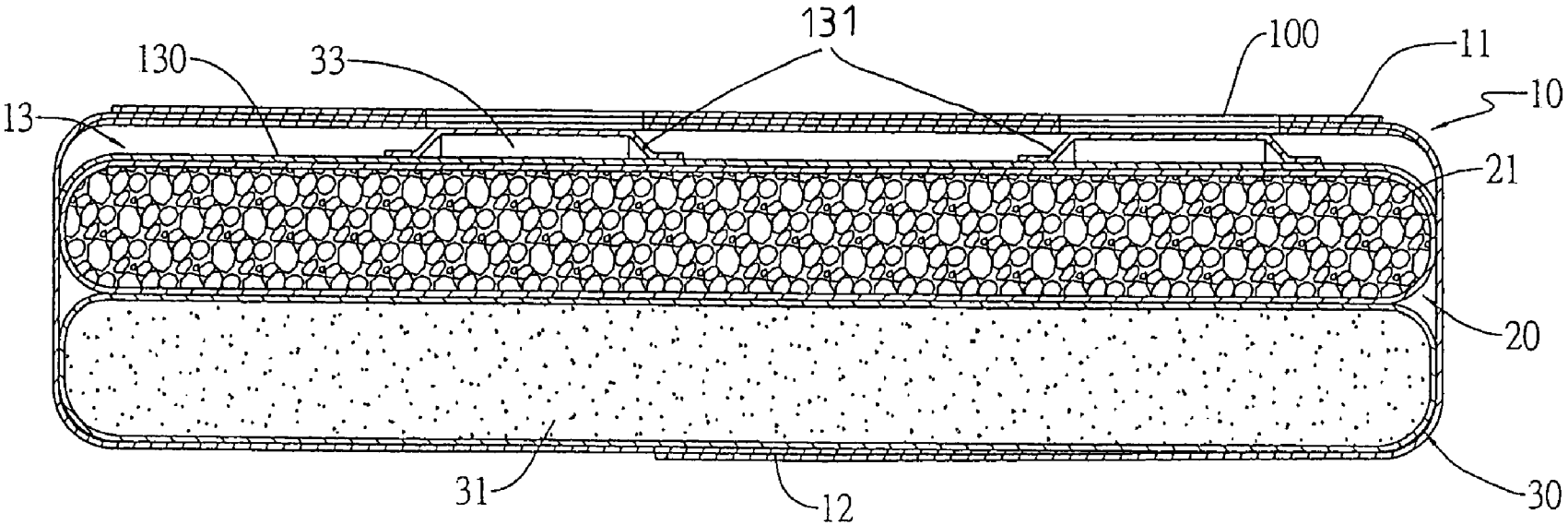
FIG. 3 is a sectional view of the healthful cushion shown in FIG. 1.

Referring to FIGS. 1 to 3, a healthful cushion according to the present invention includes following parts.

An outer shield member 10, which has six cloth strip members 11 constituting a cross structure with four extending outward sections by way of crossing sewing. Each of the cloth strip members 11 provides a secure part 12 at both ends thereof and it is preferable that the secure part 12 is made of Velcro. Of course, the secure part 12 at both ends of the respective cloth strip member 11 can be a button and a buttonhole respectively instead. The outer shield member 10 has a plurality of openings 100 and in order to locate the cloth strip members 11, buttons 110 can be provided on the cloth strip member 11.

A plastic pad 13, which provides a Velcro sheet 130 and a plurality of magnetic pieces 33 corresponding to the openings 100 of the outer shield member 10, in which each of the magnetic pieces 33 is covered with a net cloth 131 at the upper side thereof.

A first cushion member 20, which is a quadrilateral bag corresponding to the central position of the cross shape structure of the shield member 10. The first cushion member 20 provides zippers 21 at the periphery thereof and is stuffed with crystal granules 22.

A second cushion member 30, which provides the same configuration as the first cushion member 20 and zippers 31 are disposed at the periphery thereof with soft stuff inside. It is preferable that the soft stuff is infrared fiber polyester foam.

Referring to FIG. 3 again, the first cushion member 20 is placed above the second cushion member 30 during the summer time. Then, the plastic pad 13 and the outer shield member 10 are placed on the first cushion member 20 sequentially. Finally, the first and second cushion members 20, 30 are wrapped with the four extending outward sections of the outer shield member 10 and the secure part 12 at both ends of the respective cloth strip member 11 engage with each other at the bottom of the second cushion member 30. While in use, the user sits on the outer shield member 10, which encloses the second cushion member 30 and the first cushion member 20, and experiences the feeling of softness and warmness. Further, the blood circulation of the user can be promoted with the infrared polyester foam stuffed in the second cushion member to remove fatigue effectively.

Figure 4:
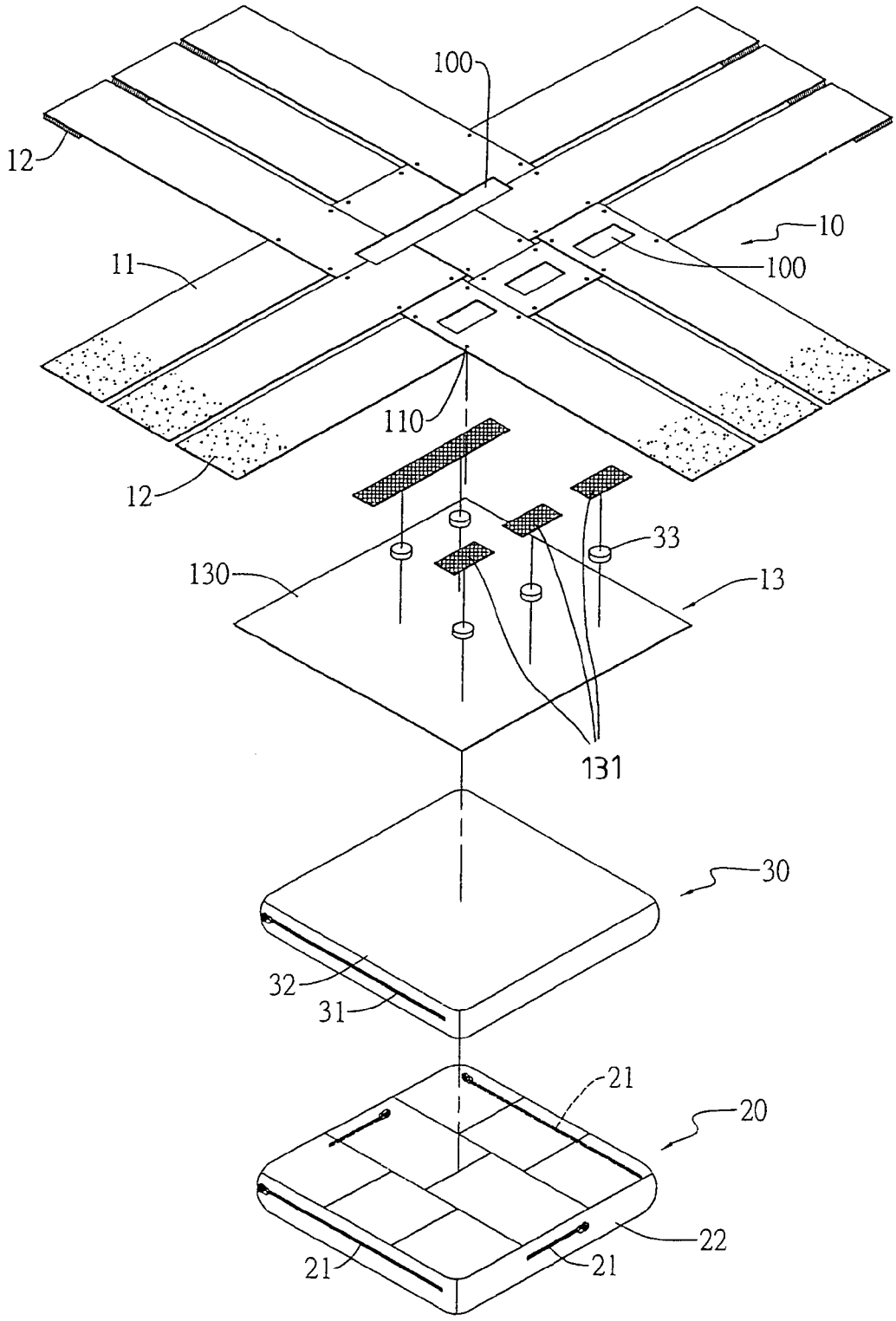
FIG. 4 is an exploded perspective view a healthful cushion of a second preferred embodiment according to the present invention.
Figure 5:
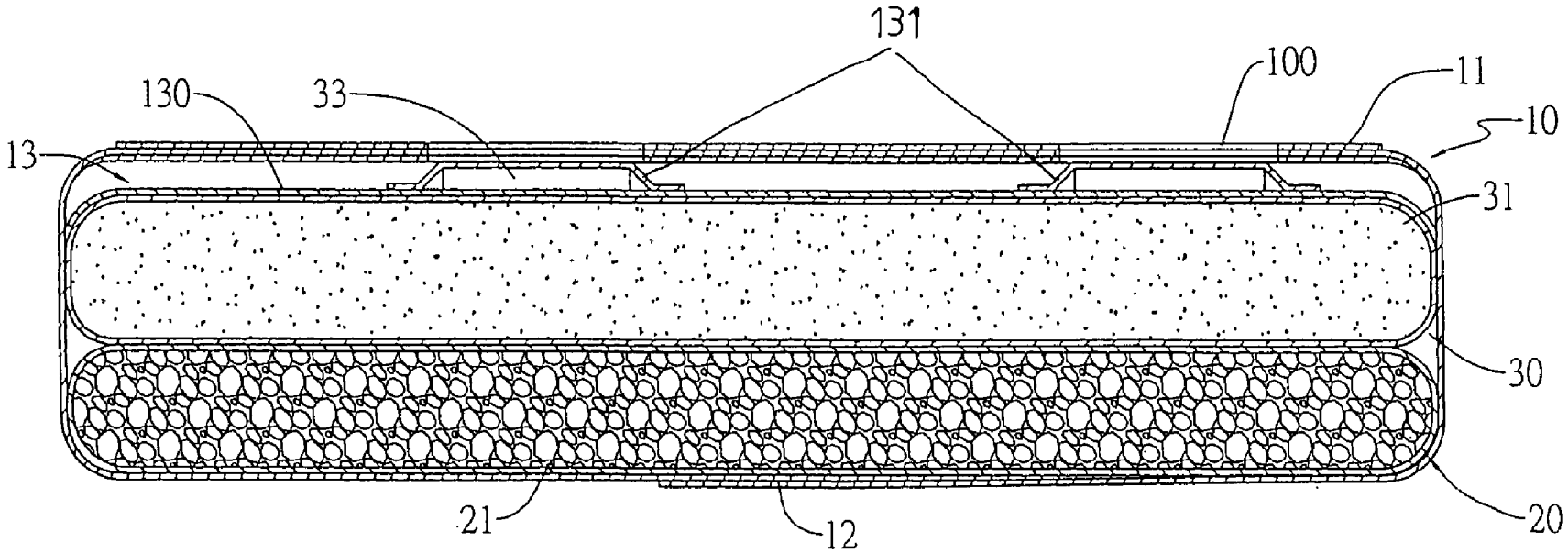
FIG. 5 is a sectional view of the healthful cushion shown in FIG. 2.

Referring to FIGS. 4 and 5, the second cushion member 20 is placed above the first cushion member 30 during the wintertime. Then, the plastic pad 13 and the outer shield member 10 are placed on the first cushion member 20 sequentially. Finally, the first and second cushion members 20, 30 are wrapped with the four extending outward sections of the outer shield member 10 and the secure part 12 at both ends of the respective cloth strip member 11 engage with each other at the bottom of the second cushion member 30. While in use, the user sits on the outer shield member 10, which encloses the first cushion member 20 and the second cushion member 30, and experiences the feeling of the crystal granules pressing his/her hip and well ventilated comfort.

Figure 6:
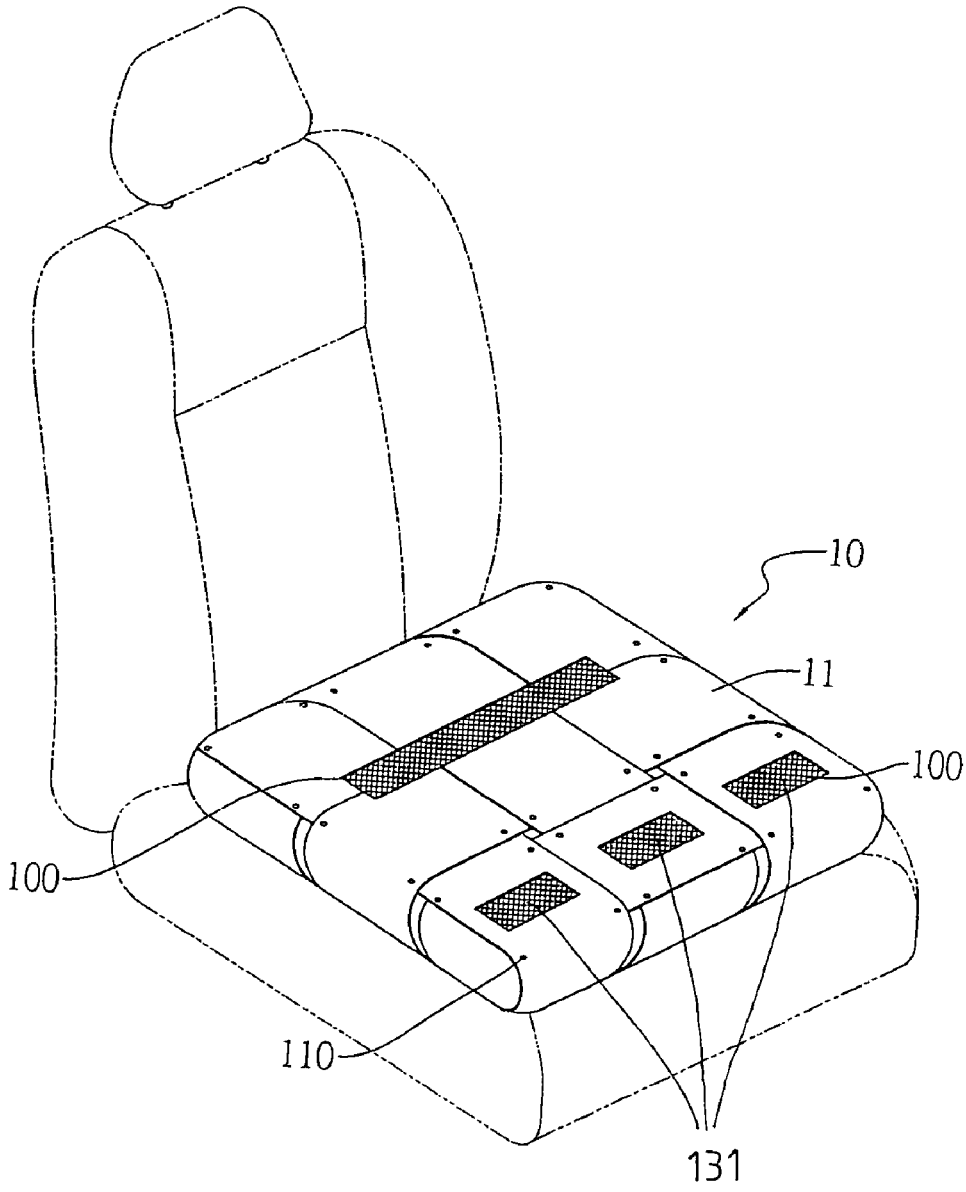
FIG. 6 is a perspective view illustrating the healthful cushion being in a state of being used.

Referring to FIG. 6, it can be seen that the healthful cushion of the present invention can be placed on the car chair directly. Hence, it is can be used conveniently and easily.

While the invention has been described with referencing to preferred embodiments thereof, it is to be understood that modifications or variations may be easily made without departing from the spirit of this invention, which is defined by the appended claims.

What is claimed is:

1. A healthful cushion, comprising:

an outer shield member, including six cloth strips sewed to form a shape of cross with a central section and four outward extending sections, the central section having a plurality of openings and each of the cloth strips having a secure part at both ends thereof for being adhered to each other;

a plastic pad, including a Velcro sheet and a plurality of magnetic pieces, and each of the magnetic pieces being covered with a net cloth at an upper side thereof;

a first cushion member, being a quadrilateral bag corresponding to the central section of the outer shield member with zippers being attached to the periphery thereof and crystals being stuffed inside thereof; and a second cushion member, providing the same configuration as the first cushion member with soft stuff inside.

2. The healthful cushion according to claim 1, wherein the secure part at both ends of the respective cloth strip is made of Velcro.

3. The healthful cushion according to claim 1, wherein the secure part at both ends of the respective cloth strip is a button and a buttonhole respectively.

* * * * *